US008758570B2

(12) United States Patent
Rossetti

(10) Patent No.: US 8,758,570 B2
(45) Date of Patent: Jun. 24, 2014

(54) TRIPLE PAPERMAKING FABRIC USE OF THE FABRIC AND PAPERMAKING METHOD

(75) Inventor: Clara Rossetti, Provaglio d'Iseo (IT)

(73) Assignee: Feltri Marone S.p.A. (IT)

( * ) Notice: Subject to any disclaimer, the term of this patent is extended or adjusted under 35 U.S.C. 154(b) by 113 days.

(21) Appl. No.: 13/122,945

(22) PCT Filed: Oct. 7, 2009

(86) PCT No.: PCT/IB2009/007060

§ 371 (c)(1),
(2), (4) Date: Jul. 2, 2011

(87) PCT Pub. No.: WO2010/041123

PCT Pub. Date: Apr. 15, 2010

(65) Prior Publication Data

US 2011/0253334 A1 Oct. 20, 2011

(30) Foreign Application Priority Data

Oct. 8, 2008 (IT) ..... MI2008A1779

(51) Int. Cl.

| | |
|---|---|
| ***D21F 1/10*** | (2006.01) |
| ***D03D 25/00*** | (2006.01) |
| ***D21F 9/02*** | (2006.01) |
| ***D21F 11/02*** | (2006.01) |

(52) U.S. Cl.
USPC ..... 162/348; 162/903; 139/383 A

(58) Field of Classification Search
CPC ... D21F 1/0045; D21F 1/0027; D21F 1/0036; D21F 1/0081; D21F 11/02; D21F 9/02; D21F 1/10; D21F 1/105; D03D 1/0094; D03D 3/04; D03D 11/00; D03D 11/02; D03D 13/008; D03D 25/00; D03D 25/005; D03D 2700/0111; D03D 2700/0114; D03D 2700/02; D03D 2700/03; D03D 2700/0155; D03D 2700/0159; D03D 2700/0162
USPC ..... 162/348, 358.2, 900–904; 139/383 A, 139/425 A, 383 AA
See application file for complete search history.

(56) References Cited

U.S. PATENT DOCUMENTS

| | | | | |
|---|---|---|---|---|
| 5,967,195 | A * | 10/1999 | Ward | 139/383 A |
| 6,978,809 | B2 * | 12/2005 | Quigley | 139/383 A |

(Continued)

FOREIGN PATENT DOCUMENTS

| | | |
|---|---|---|
| CN | 1131213 A | 9/1996 |
| EP | 1536060 A | 6/2005 |

(Continued)

OTHER PUBLICATIONS

European Patent Office as International Searching Authority; International Search Report and Written Opinion for PCT/IB2009/007060, Jul. 6, 2010 (International Filing date Oct. 7, 2009).

(Continued)

*Primary Examiner* — Eric Hug
(74) *Attorney, Agent, or Firm* — Klintworth & Rozenblat IP LLC

(57) ABSTRACT

A triple papermaking fabric includes a set of warp machine direction top yarns; a set of weft cross machine direction top yarns interwoven with the top MD yarns to form a top fabric layer; a set of bottom MD yarns; a set of bottom CMD yarns interwoven with the bottom MD yarns to form a bottom fabric layer; and a set of binding yarns arranged in the cross machine direction and interwoven with the top MD yarns and binding the top layer to the bottom layer. The binding yarns are arranged in pairs between two adjacent top CMD yarns, and in a fabric repeat unit at least one binding yarn of each pair is interwoven with at least one bottom MD yarn. The ratio between weft yarns and warp yarns is 4:2.

16 Claims, 5 Drawing Sheets

(56) References Cited

U.S. PATENT DOCUMENTS

| | | | | |
|---|---|---|---|---|
| 7,581,567 | B2 * | 9/2009 | Ward et al. | 139/383 A |
| 2004/0118473 | A1 | 6/2004 | Hay et al. | |
| 2005/0067040 | A1 | 3/2005 | Quigley | |
| 2006/0096653 | A1 | 5/2006 | Eagles | |
| 2006/0169346 | A1 | 8/2006 | Fahrer et al. | |
| 2007/0062598 | A1 | 3/2007 | Barratte | |

FOREIGN PATENT DOCUMENTS

| | | | |
|---|---|---|---|
| RU | 2324781 | C2 | 5/2008 |
| RU | 2379400 | C2 | 9/2008 |
| WO | 2004111333 | | 12/2004 |

OTHER PUBLICATIONS

May 15, 2013 Official Action from Russian Application No. 2011118394, filed Oct. 7, 2009 and translation.

* cited by examiner

TRIPLE PAPERMAKING FABRIC USE OF THE FABRIC AND PAPERMAKING METHOD

TECHNICAL FIELD

The present invention relates to a papermaking fabric, particularly (but not necessarily) intended for use as forming fabric in a forming section of a papermaking machine.

BACKGROUND ART

The traditional Fourdrinier papermaking process substantially includes three subsequent steps, carried out in corresponding sections of the papermaking machine: forming section, pressing section, drying section.

At the forming section, an aqueous pulp of cellulose fibers (and other possible components) is arranged on a so-called forming fabric or web shaped as a closed loop belt and supported by rollers. The water removal from the pulp through the forming fabric leads to the gradual formation of a wet paper material band with a still relatively high water content. A further water removal occurs at the pressing section, in which the paper material is pressed passing through one or more pairs of rollers. The paper material is then sent to the drying section for a last moisture removal. The so-formed paper is ready for the following steps of finishing and packaging.

Hereinafter, as customary in the field of papermaking and related fabric making, the terms "machine direction" (abbreviated "MD") and "cross machine direction" (abbreviated "CMD") are used to indicate a direction aligned with the feeding direction of the forming fabric in the papermaking machine and a direction parallel to the fabric surface and transversal (orthogonal) to the feeding direction, respectively. The direction or orientation of the warp and weft yarns of the forming fabric is also indicated with reference to machine direction and cross machine direction.

Furthermore, again as customary in the field, the surface of the forming fabric in contact with the cellulose pulp (i.e. with the paper material being formed) is meant to be the top surface of the fabric and the opposite surface facing the machine is the bottom surface. This reference will be also adopted to describe the vertical spatial arrangement of the yarns in the forming fabric.

Although various types of paper forming fabrics are known, in particular for use in the forming section, enhancement margins in this field still appear to exist, e.g. in terms of mechanical strength, stability, durability, draining capacity and quality of the formed paper.

DISCLOSURE OF INVENTION

It is thus an object of the present invention to provide a papermaking fabric possessing all these features to a satisfactory extent, particularly being fully effective, highly draining, strong and stable over time, thus ensuring the formation of high quality paper.

The present invention thus relates to a papermaking fabric as defined in essential terms in accompanying claim 1, and the additional features thereof are set forth in the dependent claims.

The present invention further relates to the use of such a fabric in a papermaking machine, and specifically in the forming section of the machine, as well as a papermaking process using such a fabric, as defined in accompanying claims 14 and 16, respectively.

BRIEF DESCRIPTION OF THE DRAWINGS

The invention is further described in the following non-limitative embodiments, with reference to the accompanying drawings, in which.

BEST MODE FOR CARRYING OUT THE INVENTION

Figure 1:
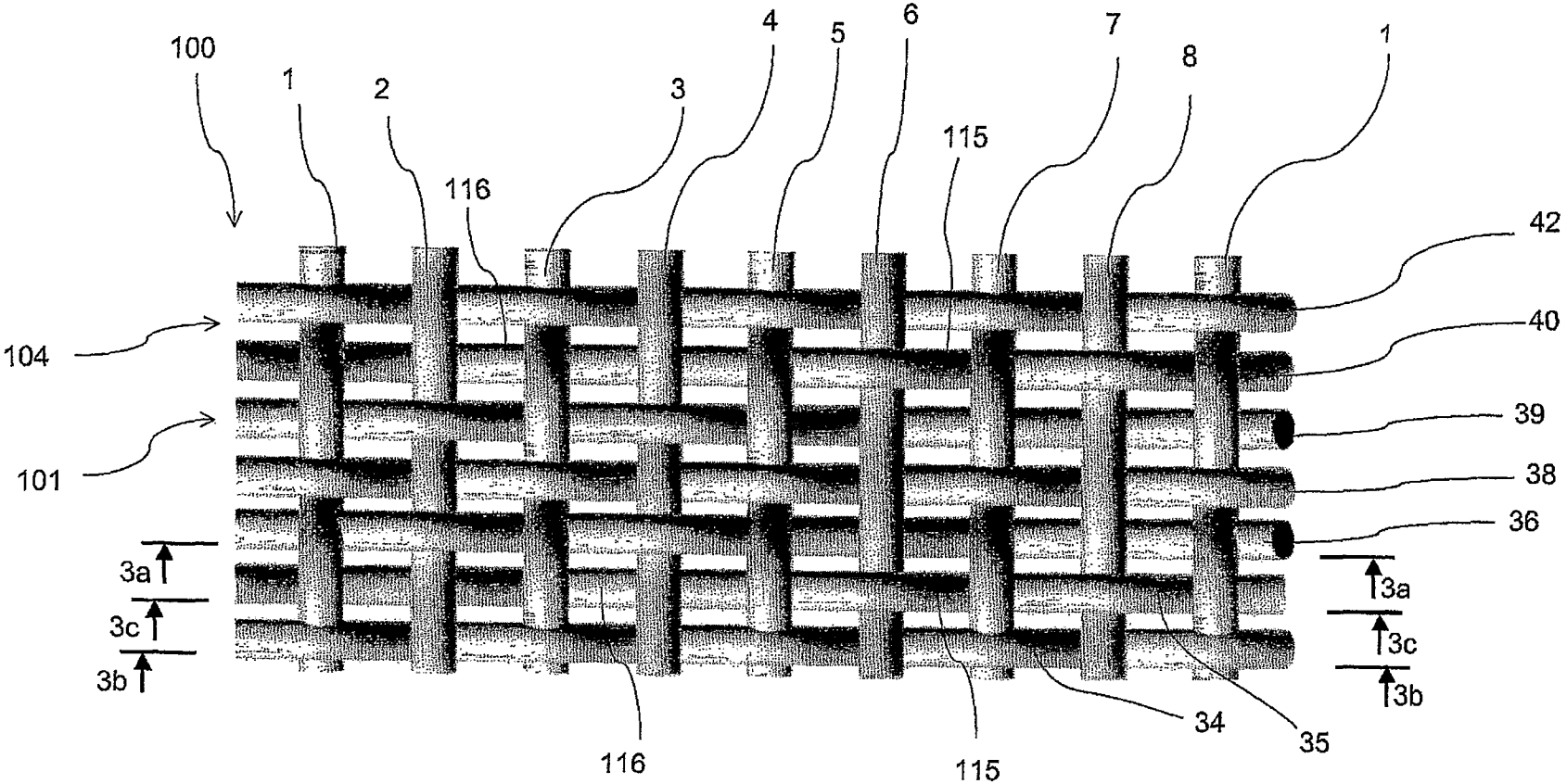
FIG. 1 is a diagrammatic top plan view of a top layer of a fabric according to the invention (showing one fabric repeat unit and the initial part of the next unit)

With reference to the accompanying drawings, numeral 100 indicates as a whole a papermaking fabric, in particular a forming fabric to be used in the forming section of a papermaking machine; in the example shown, the fabric 100 is a 16-harness triple fabric.

Fabric 100 comprises a top layer 101 and a bottom layer 102 both formed, as customary, by corresponding repeat units which form a fabric repeat unit 104 as a whole; the figures show one fabric repeat unit 104, as well as the initial part of the adjacent repeat unit (the corresponding yarns of the adjacent repeat units are indicated by the same numbers); it is understood that in commercial and industrial applications the unit 104, as well as the repeat units of the single layers 101, 102, may be repeated several times, both in machine direction and in cross machine direction, for forming a fabric 100 suitably sized for use on a papermaking machine.

Fabric 100 is generally formed by longitudinal warp yarns which extend in machine direction (MD) and by transversal weft yarns, substantially orthogonal to the previous yarns, which extend in cross machine direction (CMD). Hereinafter (and as customary in the field), the longitudinal warp yarns extending in machine direction will be referred to as "MD yarns", and the transversal weft yarns extending in cross machine direction as "CMD yarns", for conciseness purposes.

In this case, a repeat unit 104 of fabric 100 includes eight top MD yarns 1-8, three top CMD yarns 34,38,42, eight bottom MD yarns 9-16, three bottom CMD yarns 33,37,41, and four binding yarns 35,36,39,40 arranged in pairs and comprising respective supporting portions 115 and respective binding portions 116.

The interweaving or weaving of these yarns to form the fabric 100 is described in detail below.

The top layer 101 (FIG. 1) includes the top MD yarns 1-8 and the top CMD yarns 34,38,42, as well as the supporting portions 115 of the binding yarns 35,36;39,40.

Figure 2:
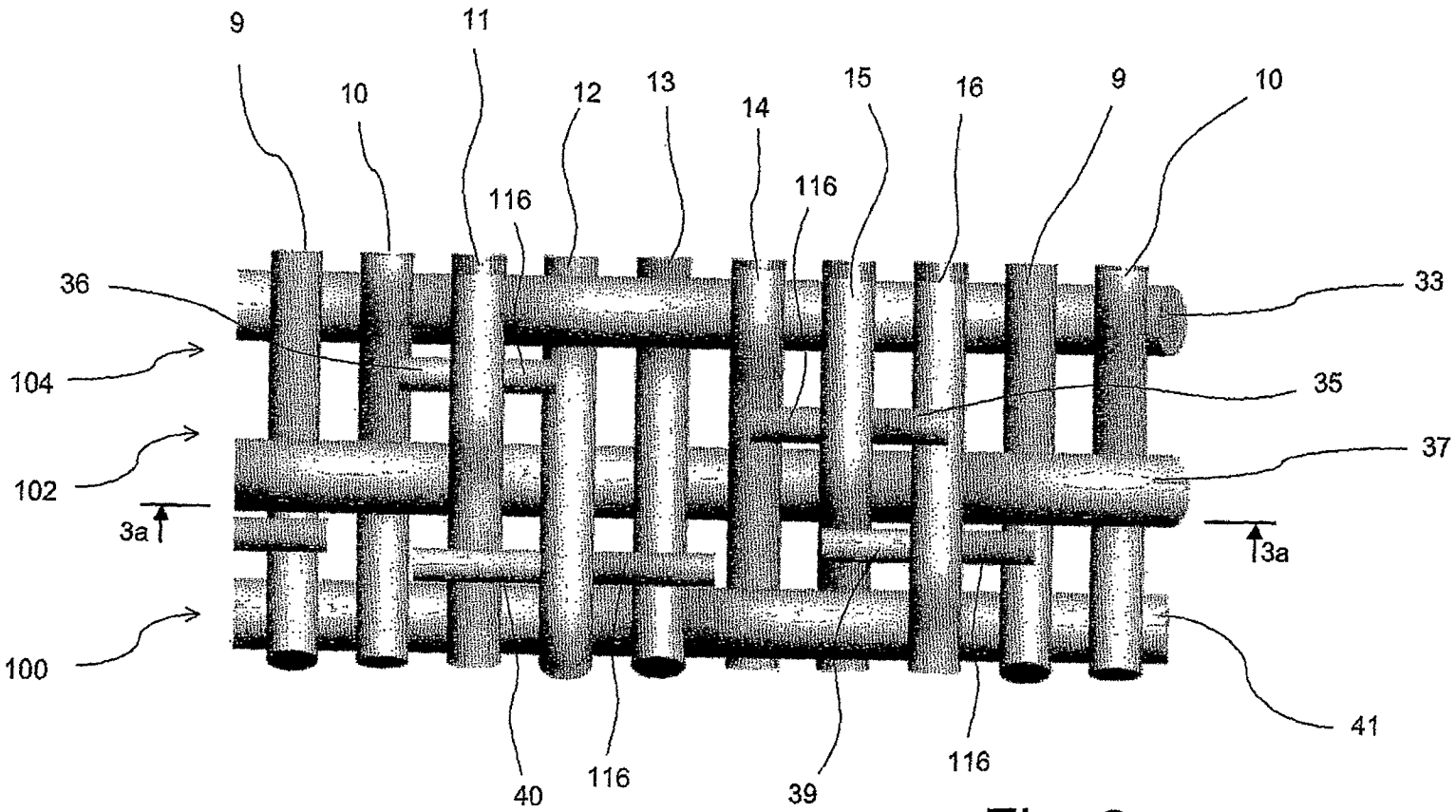
FIG. 2 is a diagrammatic top plan view of a bottom layer of the fabric in FIG. 1.

The bottom layer 102 (FIG. 2) comprises the bottom MD yarns 9-16 and the bottom CMD yarns 33,37,41, as well as the binding portions 116 of the binding yarns 35,36;39,40 which extend to bind the bottom MD yarns 9-16.

The top MD yarns 1-8 and the top CMD yarns 34,38,42 are interwoven so that each top CMD yarn 34,38,42 alternatively passes over and under the top MD yarns 1-8; all top CMD yarns 34,38,42 are similarly interwoven with top MD yarns, i.e. they pass over and under the same top MD yarns; in particular, each top CMD yarn 34,38,42 passes over the odd top MD yarns 1, 3, 5, 7 and under the even top MD yarns 2, 4, 6, 8. The same pattern is followed by all the top CMD yarns 34,38,42.

Layers 101, 102 are joined and bound to each other to form the fabric 100 by means of binding yarns 35,36;39,40 arranged in pairs.

As shown in FIG. 1, each pair of binding yarns 35,36;39,40 is arranged between two adjacent top CMD yarns 34,38,42. For example, the pair of binding yarns 35,36 is arranged between the top CMD yarns 34,38 and the pair of binding yarns 39,40 is arranged between the top CMD yarns 38,42.

Each binding yarn 35,36;39,40 in a fabric repeat unit 104 comprises a supporting portion 115, which is interwoven with the top MD yarns 1-8, and a binding portion 116 which is arranged under the top MD yarns 1-8 and is interwoven with the bottom MD yarns 9-16.

In the non-limitative example shown, the supporting portion 115 of every binding yarn 35,36,39,40 is interwoven with (i.e. alternatively passes over and under) three consecutive top MD yarns 1-8, and the binding portion 116 passes instead under the remaining top MD yarns 1-8 for binding at least one bottom MD yarn 9-16.

The binding yarns 35,36;39,40 of each pair (although shown side by side in the diagrammatic out-of-scale view in FIG. 1, for clarity purposes) are interwoven and vertically overlaying, so that the supporting portions 115 of a binding yarn of the pair are overlaying the binding portions 116 of the other binding yarn of the pair and vice versa; the two binding yarns 35,36;39,40 of a pair intersect at some of the top MD yarns 1-8 which define respective transition MD yarns (in this case, the top MD yarns 1,5), under which a binding yarn of each pair crosses the other binding yarn of the pair, and which define the transition between the supporting portions 115 and the binding portions 116.

The interweaving of each pair of binding yarns 35,36;39,40 with the top MD yarns 1-8 and the bottom MD yarns 9-16 may take several forms.

For example, with reference to the pair of binding yarns 35,36, the supporting portion 115 of the odd binding yarn 35 is interwoven in each fabric repeat unit 104 with three top MD yarns (6-8) in an alternating manner, alternatively passing over the two even top MD yarns (6,8) and under the odd top MD yarn (7); the supporting portion 115 of the even binding yarn 36 passes over the remaining two even top MD yarns (2,4) and passes under the odd top MD yarn (3) therebetween. Both the binding yarns 35,36 of the pair pass under the top transition MD yarns (1, 5).

With their respective supporting portions 115, the binding yarns 35,36;39,40 of each pair pass over those top MD yarns under which the top CMD yarns 34,38,42 pass instead; in other words, the supporting portions 115 of the binding yarns 35,36;39,40 pass over the even top MD yarns 2, 4, 6, 8, 10, 12 (for each pair of binding yarns 35,36;39,40, either binding yarns pass over each even top MD yarn). The supporting portions 115 of the binding yarns 35,36;39,40 pass instead under those top MD yarns over which the top CMD yarns 34,38,42 pass, i.e. under the odd top MD yarns 1, 3, 5, 7, 9, 11. For example, with its supporting portion 115, the binding yarn 35 passes over the top MD yarns 6,8 while passing under the top MD yarn 7; and with its supporting portion 115, the binding yarn 36 passes over the top MD yarns 2,4 and under the top MD yarns 3. Both the binding yarns 35,36 pass under the top transition MD yarns 1,5. The other pair of binding yarns 39,40 is similarly interwoven but it is preferably offset with respect to the pair of adjacent binding yarns 35,36 by one or more top MD yarns. Thereby, the binding yarns 35,36;39,40 and the top CMD yarns 34,38,42 as a whole form a plain weave (web) with the top MD yarns 1-8.

It is understood that other types of weave or other weaving patterns may be used. Other interweaving patterns are obviously possible between the binding yarns 35,36;39,40 and the top MD yarns 1-82, and the pairs of binding yarns 35,36;39,40 may also follow weave patterns which are different from one another.

With reference to FIGS. 2 and 3*a*,3*b*,3*c*, the bottom layer 102 includes: the bottom MD yarns 9-16, the bottom CMD yarns 33,37,41, and the binding portions 116 of the binding yarns 35,36;39,40.

The bottom CMD yarns 33,37,41 are interwoven with the bottom MD yarns 9-16 with an "over2/under6" sequence. For example (FIG. 3*a*), the bottom CMD yarn 37 passes over the adjacent bottom MD yarns 9-10 and under the bottom MD yarns 11-16. The other bottom CMD yarns 33,41 follow a similar "over2/under6" weave pattern with respect to the bottom MD yarns 9-16, but each one is offset with respect to the previous one in cross machine direction, so as to form a broken weft reps-type weave.

Obviously, this is again only an example of weave, and other weave patterns may also be used.

Figure 3A:
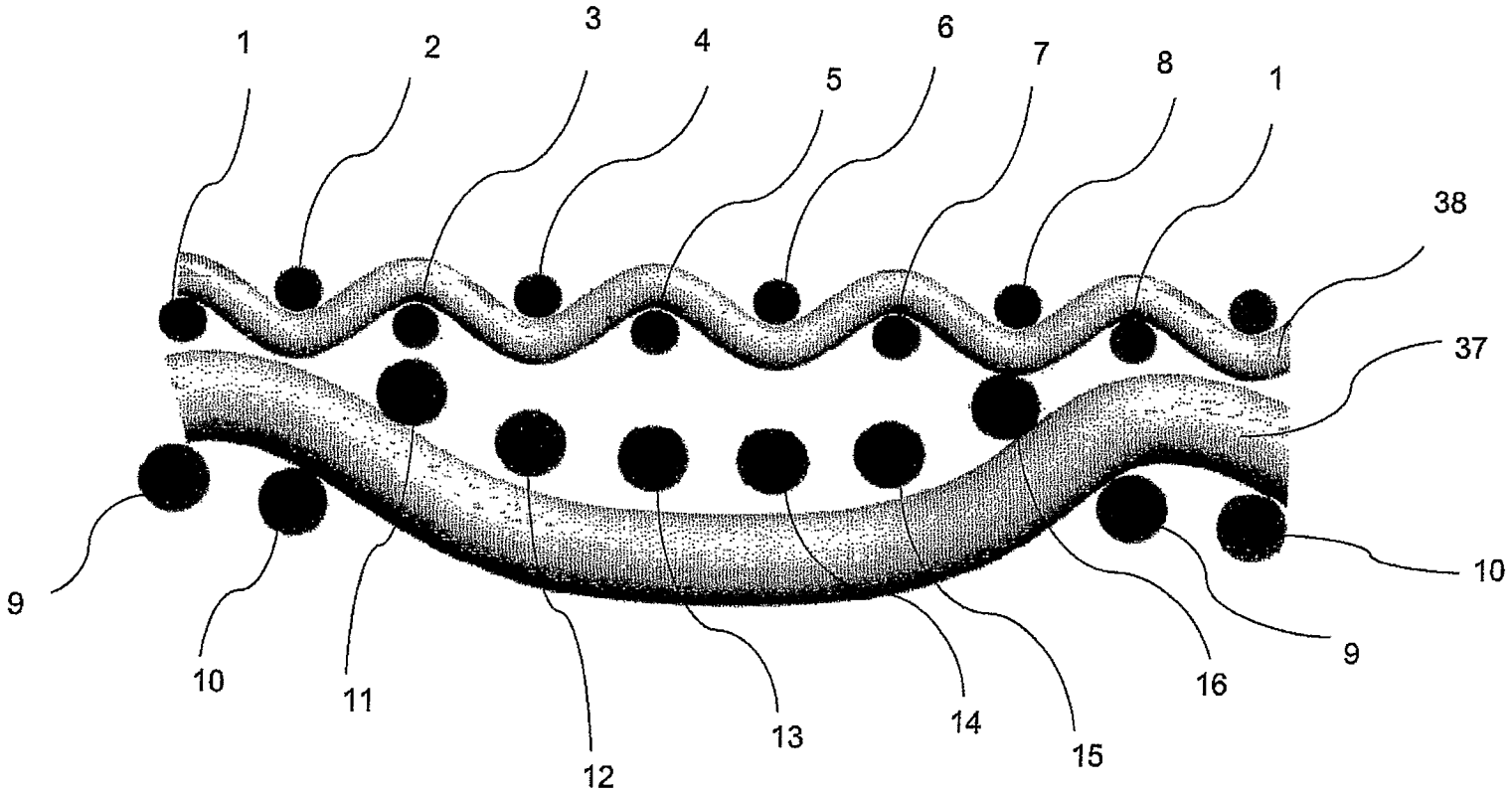
FIGS. 3*a*, 3*b*, 3*c* are section views taken along plotting planes 3*a*-3*a*, 3*b*-3*b*, 3*c*-3*c* of FIGS. 1 and 2, respectively.
Figure 3B:
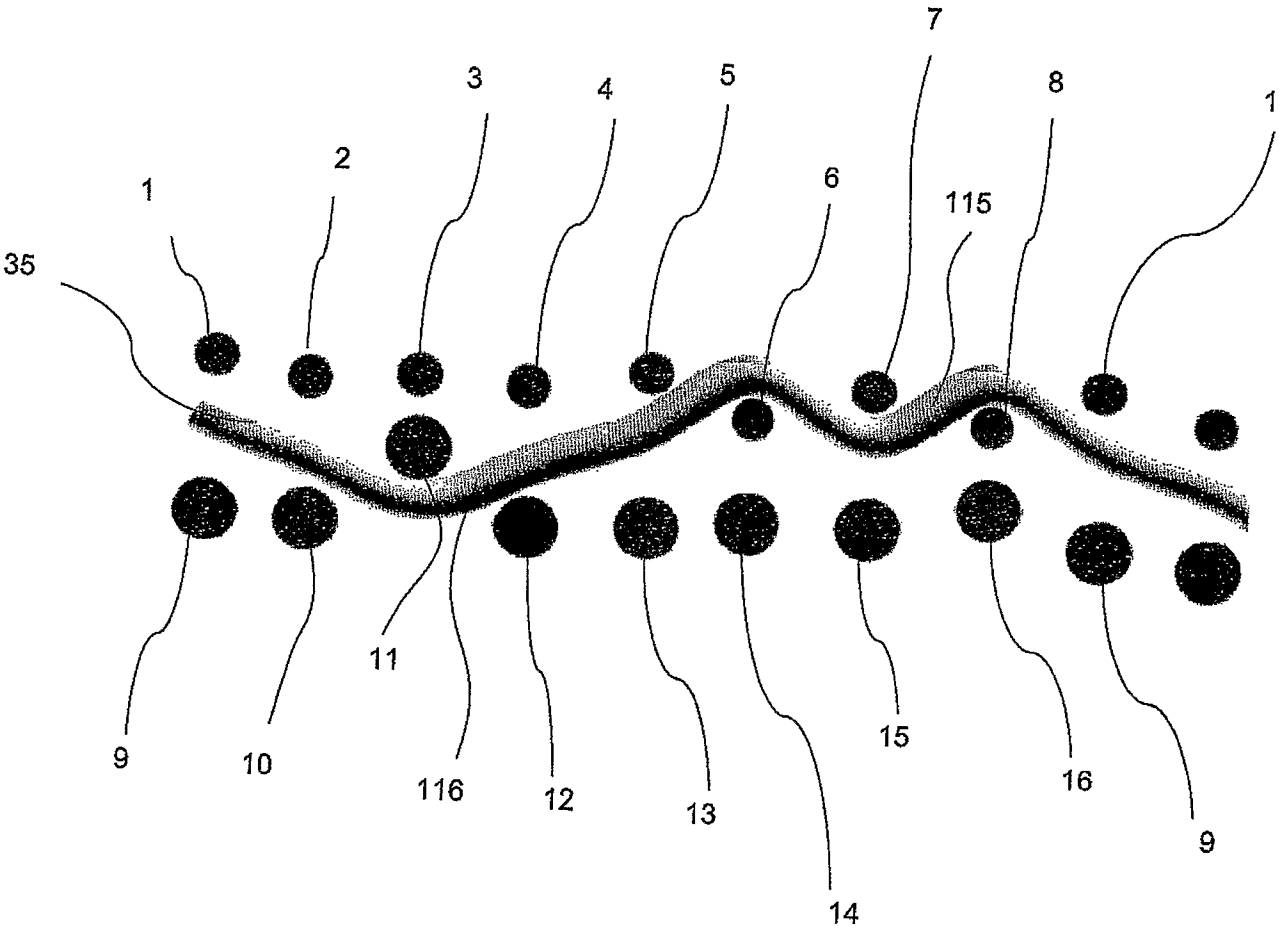
Figure 3C:
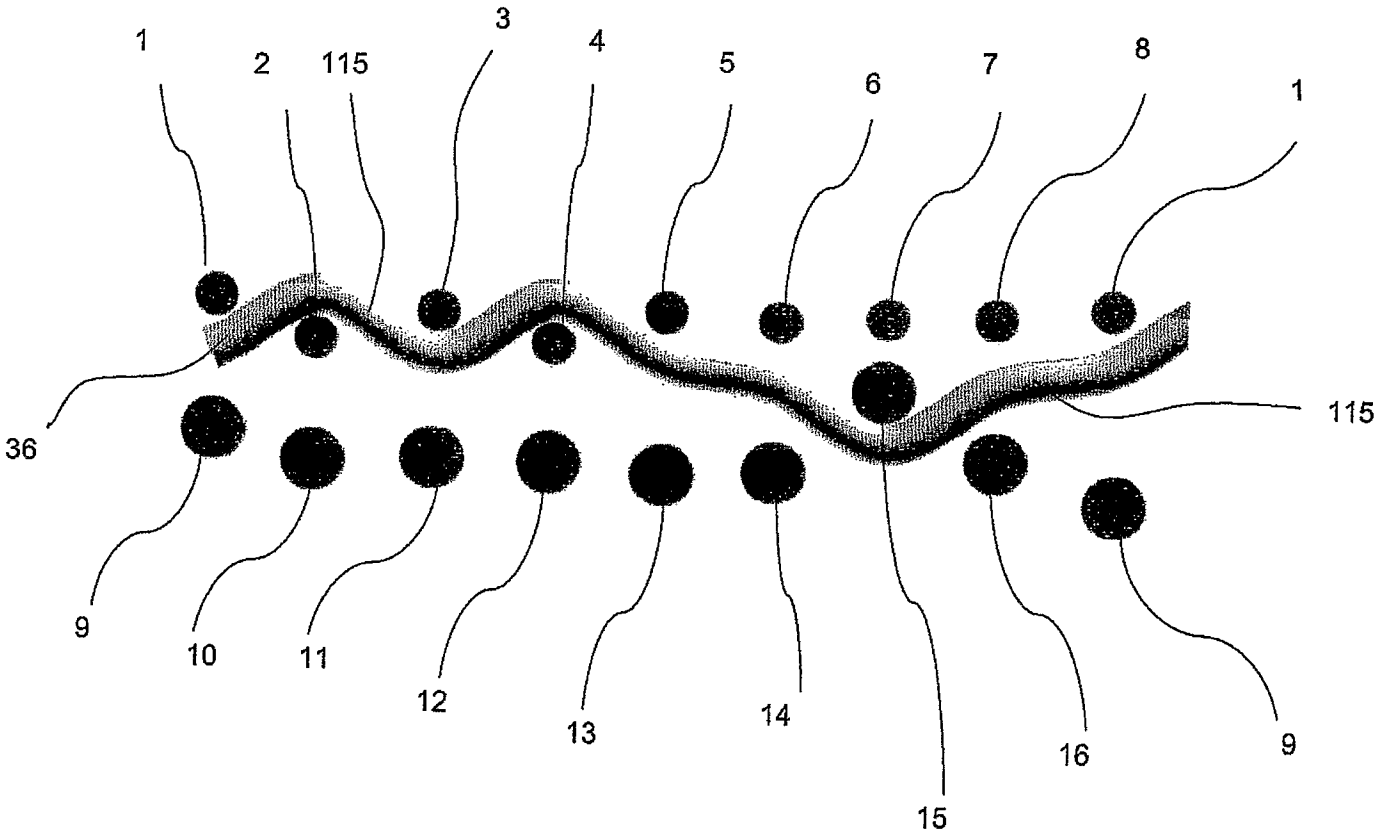

The bottom layer 102 also includes (FIG. 2) the binding portions 116 of the binding yarns 35,36;39,40. In the repeat unit 104, with its binding portion 116, each binding yarn 35,36;39,40 passes under a bottom MD yarn 9-16 so as to define a pattern between the pairs of binding yarns 35,36;39,40 and the bottom MD yarns 9-16 on the bottom surface of the fabric (FIGS. 2,3*a*,3*b*,3*c*). For example, the binding yarn 35 passes under the bottom MD yarn 11 and the binding yarn 36 passes under the bottom MD yarn 15; both binding yarns 35,36 pass over all the other bottom MD yarns 9-10,12-14,16 (FIGS. 3*b*,3*c*). Therefore, as a whole, the binding yarns 35,36 define an "over1/under3/over1/under3" pattern with respect to the bottom MD yarns 9-16; the binding yarns 39,40 of the other pair follow an "over2/under6" pattern but are preferably offset with respect to the binding yarns 35,36 by one or more bottom MD yarns.

As seen in the figures as a whole, in the repeat unit 104 of fabric 100, each mesh has two warp yarns (MD yarns) and four waft yarns (i.e. CMD yarns); for example, at each mesh, the top MD yarn 1 and the bottom MD yarn 9, one of the top of the other (as well as all subsequent pairs of overlaying MD yarns), are associated with a top CMD yarn (e.g. 38; FIG. 3*a*), a pair of binding yarns (e.g. 35,36; FIGS. 3*b*,3*c*), and a bottom CMD yarn (e.g. 37; FIG. 3*a*).

In other words, at each pair of overlaying MD yarns (each pair being formed by a top MD yarn and a bottom MD yarn vertically overlaying) there are four CMD yarns. Each pair of warp yarns is associated with four weft yarns; the ratio between weft yarns (CMD yarns) and warp yarns (MD yarns) is thus 4:2.

A person skilled in the art will recognize that the fabrics according to the present invention may take different forms. For example, as far as the previous description, the number and/or position of the pairs of binding yarns may be varied with respect to a number and/or position of the top CMD yarns (e.g. there may be a pair of binding yarns every two or three or more top CMD yarns, or there may be two or three or more pairs of binding yarns for each top CMD yarn).

The number of the top and bottom CMD yarns in the fabric repeat unit may also vary with respect to the above description and disclosure given by way of mere example.

Furthermore, all weave patterns or weaves described for the layers 101, 102 may differ from those illustrated and described; for example, the top surface of the fabric does not necessarily need to be formed by a plain weave as shown, but may be of satin-, twill-type, etc.; and the bottom surface of the fabric does not necessarily need to be a broken weft reps-type weave, but may be of any other form, such as a plain weave (web), a broken twill weave, a twill, etc. Other further variants of weave patterns may be used in the fabric according to the present invention.

The form of the yarns used in the fabric of the invention may also vary according to the properties intended to be imparted to the end product. For example, the yarns may be monofilament yarns, flat monofilament yarns, multifilament yarns, twisted multifilament or monofilament yarns, yarns of any type, or any combination thereof. The materials of which yarns are made may be those commonly used in the field. For example, polyester, polyamide, polyamide/polyester yarns or the like may be used. A person skilled in the art will be able to select the materials of the yarns also according to the specific application for which the end product is intended.

Furthermore, yarns of various shapes (e.g. having a round or flat section) and sizes may be used. For example, the top MD yarns, the top CMD yarns and the binding yarns may have a (reciprocally equivalent or different) diameter from about 0.09 to 0.19 mm; the bottom MD yarns may have a diameter from about 0.13 to 0.25 mm; the bottom CMD yarns may have a diameter from about 0.18 to 0.35 mm; it is understood that these are merely exemplary sizes, and differently sized yarns may be used depending on particular needs.

The mesh (i.e. the size of the mesh) of the fabric may also vary. For example, the mesh size of the top surface may range from about 22×32 to 32×55 (warp yarns epcm×weft mesh epcm) and the total mesh size may range from about 48×64 to 71×110.

A fabric having a bottom layer with broken weft reps-type weave provided according to the invention has the features shown in table 1, for example.

TABLE 1

| YARN | Size |
|---|---|
| Top MD | 0.14 mm |
| Bottom MD | 0.20 mm |
| Binding | 0.13 mm |
| Top CMD | 0.13 mm |
| Bottom CMD | 0.30 mm |
| Mesh (top surface) | 30 × 57* |
| Mesh (total) | 60 × 76* |

*warp yarns epcm × weft mesh epcm

According to a further aspect of the invention, the above-described fabric 100 is used in a papermaking process, in particular at the forming section of a papermaking machine. The process includes the steps of:

(a) preparing a papermaking fabric as previously described;

(b) applying an aqueous cellulose pulp and/or a paper material being formed onto the top fabric surface; and (c) removing water from the pulp and/or the paper material being formed.

As for the rest, such a process is essentially well known by a person skilled in the art, whereby further related details are not required.

Moreover, it is understood that changes and variations may be made to the description disclosed herein, without departing from the scope of the invention as defined in the appended claims.

The invention claimed is:

1. A triple papermaking fabric (100), having at least one fabric repeat unit (104) and comprising:

a set of warp machine direction (MD) top yarns (1-8);

a set of weft cross machine direction (CMD) top yarns (34,38,42) interwoven with the top MD yarns to form a top fabric layer (101);

a set of bottom MD yarns (9-16);

a set of bottom CMD yarns (33,37,41) interwoven with the bottom MD yarns to form a bottom fabric layer (102);

a set of binding yarns (35,36;39,40) arranged in the cross machine direction and interwoven with the top MD yarns and that bind the top layer (101) to the bottom layer (102);

wherein the set of binding yarns (35,36;39,40) are arranged in pairs;

further wherein with respect to yarns in the repeat unit (104):

at least one binding yarn (35,36;39,40) of each pair is interwoven with at least one bottom MD yarn (9-16);

each binding yarn (35,36;39,40) binds only one bottom MD yarn (9-16);

binding yarns (35,36;39,40) of each pair are interwoven with respective groups of different top MD yarns (1-8);

the top CMD yarns (34,38,42) are interwoven only with the top MD yarns (1-8) and do not interweave with the bottom MD yarns (9-16); and the bottom CMD yarns (33,37,41) are interwoven only with the bottom MD yarns (9-16) and do not interweave with the top MD yarns (1-8);

the number of top CMD yarns (34,38,42) and bottom CMD yarns (33,37,41) are identical;

each bottom CMD yarn (33,37,41) passes over two adjacent bottom MD yarns (9-16) and under all the remaining bottom MD yarns (9-16);

the top MD yarns (1-8), the top CMD yarns (34,38,42) and the binding yarns (35,36;39,40) as a whole form a plain weave pattern on a top surface of the triple papermaking fabric (100).

2. The triple papermaking fabric according to claim 1, wherein the ratio between weft yarns and warp yarns is 4:2.

3. The triple papermaking fabric according to claim 1, wherein each pair of binding yarns (35,36;39,40) is positioned between two adjacent top CMD yarns (34,38,42).

4. The triple papermaking fabric according to claim 1, wherein the binding yarns (35,36;39,40) of each pair bind respective different bottom MD yarns (9-16).

5. The triple papermaking fabric according to claim 1, wherein the triple papermaking fabric (100) has a top surface having a mesh ranging between about 22×32 and 32×55 (epcm to ppcm).

6. A papermaking machine for conveying a cellulose pulp and/or a paper material to be formed, comprising the triple papermaking fabric (100) according to claim 1.

7. A papermaking machine for conveying a cellulose pulp and/or a paper material to be formed according to claim 6, wherein the triple papermaking fabric (100) comprises a forming fabric in a forming section of the papermaking machine.

8. A papermaking method, comprising the steps of:

(a) providing a triple papermaking fabric according to claim 1;

(b) applying on the triple papermaking fabric an aqueous cellulose pulp and/or a paper material to be formed; and (c) removing water from the aqueous cellulose pulp and/or the paper material.

9. A triple papermaking fabric (100), having at least one fabric repeat unit (104) and comprising:

a set of warp machine direction (MD) top yarns (1-8);

a set of weft cross machine direction (CMD) top yarns (34,38,42) interwoven with the top MD yarns to form a top fabric layer (101);

a set of bottom MD yarns (9-16);

a set of bottom CMD yarns (33,37,41) interwoven with the bottom MD yarns to form a bottom fabric layer (102);

a set of binding yarns (35,36;39,40) arranged in the cross machine direction and interwoven with the top MD yarns and that bind the top layer (101) to the bottom layer (102);

wherein the set of binding yarns (35,36;39,40) are arranged in pairs;

further wherein with respect to yarns in the repeat unit (104):

at least one binding yarn (35,36;39,40) of each pair is interwoven with at least one bottom MD yarn (9-16);

each binding yarn (35,36;39,40) binds only one bottom MD yarn (9-16);

binding yarns (35,36;39,40) of each pair are interwoven with respective groups of different top MD yarns (1-8);

the top CMD yarns (34,38,42) are interwoven only with the top MD yarns (1-8) and do not interweave with the bottom MD yarns (9-16); and the bottom CMD yarns (33,37,41) are interwoven only with the bottom MD yarns (9-16) and do not interweave with the top MD yarns (1-8);

the number of top CMD yarns (34,38,42) and bottom CMD yarns (33,37,41) are identical;

each bottom CMD yarn (33,37,41) passes over two adjacent bottom MD yarns (9-16) and under all the remaining bottom MD yarns (9-16);

the triple papermaking fabric (100) has a top surface having a mesh ranging between about 22×32 and 32×55 (epcm to ppcm).

10. The triple papermaking fabric according to claim 9, wherein the ratio between weft yarns and warp yarns is 4:2.

11. The triple papermaking fabric according to claim 9, wherein each pair of binding yarns (35,36;39,40) is positioned between two adjacent top CMD yarns (34,38,42).

12. The triple papermaking fabric according to claim 9, wherein the binding yarns (35,36;39,40) of each pair bind respective different bottom MD yarns (9-16).

13. The triple papermaking fabric according to claim 9, wherein the top MD yarns (1-8), the top CMD yarns (34,38,42) and the binding yarns (35,36;39,40) as a whole form a plain weave pattern on a top surface of the triple papermaking fabric (100).

14. A papermaking machine for conveying a cellulose pulp and/or a paper material to be formed, comprising the triple papermaking fabric (100) according to claim 9.

15. A papermaking machine for conveying a cellulose pulp and/or a paper material to be formed according to claim 14, wherein the triple papermaking fabric (100) comprises a forming fabric in a forming section of the papermaking machine.

16. A papermaking method, comprising the steps of:

(a) providing a triple papermaking fabric according to claim 9;

(b) applying on the triple papermaking fabric an aqueous cellulose pulp and/or a paper material to be formed; and (c) removing water from the aqueous cellulose pulp and/or the paper material.

* * * * *